US010814372B2

(12) United States Patent
Minor, Sr. et al.

(10) Patent No.: US 10,814,372 B2
(45) Date of Patent: Oct. 27, 2020

(54) METHOD FOR STRATEGICALLY MARKING A GUTTER

(71) Applicants: Kenneth W. Minor, Sr., Channahon, IL (US); Keith W. Minor, Channahon, IL (US)

(72) Inventors: Kenneth W. Minor, Sr., Channahon, IL (US); Keith W. Minor, Channahon, IL (US)

(73) Assignee: KWM GUTTERMAN INC., Rockdale, IL (US)

( * ) Notice: Subject to any disclaimer, the term of this patent is extended or adjusted under 35 U.S.C. 154(b) by 429 days.

(21) Appl. No.: 15/615,934

(22) Filed: Jun. 7, 2017

(65) Prior Publication Data

US 2018/0354015 A1 Dec. 13, 2018

(51) Int. Cl.

| | |
|---|---|
| ***B21D 5/06*** | (2006.01) |
| ***B21C 51/00*** | (2006.01) |
| ***E04D 13/072*** | (2006.01) |
| ***E04D 13/064*** | (2006.01) |
| ***B21D 5/08*** | (2006.01) |

(52) U.S. Cl.

CPC ..... *B21D 5/06* (2013.01); *B21C 51/005* (2013.01); *B21D 5/08* (2013.01); *E04D 13/064* (2013.01); *E04D 13/0725* (2013.01)

(58) Field of Classification Search

CPC . B21C 51/005; E04D 13/064; E04D 13/0445; E04D 13/0725; B21D 5/08; B21D 5/086; B21D 22/04; B21D 5/06; B21D 5/14; B21D 5/083

USPC ..... 72/168, 179, 181, 182, 176, 180

See application file for complete search history.

(56) References Cited

U.S. PATENT DOCUMENTS

| | | | | | |
|---|---|---|---|---|---|
| 262,723 | A * | 8/1882 | Austin | B21D 5/08 | 72/168 |
| 1,793,352 | A * | 2/1931 | Bell | B21D 51/20 | 72/130 |
| 2,674,941 | A * | 4/1954 | Hopwood | B21C 51/005 | 101/212 |
| 3,150,707 | A * | 9/1964 | Howell | E04B 1/18 | 72/177 |
| 3,612,453 | A * | 10/1971 | Zimmer | E04D 13/0727 | 248/48.2 |

(Continued)

FOREIGN PATENT DOCUMENTS

| | | | | |
|---|---|---|---|---|
| AU | 2016273824 | A1 * | 1/2017 | E04D 13/064 |
| DE | 102012205660 | A1 * | 10/2012 | E04D 13/0727 |

*Primary Examiner* — Shelley M Self
*Assistant Examiner* — Jared O Brown
(74) *Attorney, Agent, or Firm* — Wood, Phillips, Katz, Clark & Mortimer

(57) ABSTRACT

A gutter piece and a method of forming the gutter piece including the steps of: obtaining a gutter forming apparatus with a marking subassembly; obtaining a supply of gutter material; through the gutter forming apparatus, progressively forming the gutter material into completed gutter pieces, each with a length, as the gutter material is advanced in a forming path; and through the subassembly, continuously making discrete visible marks on the gutter material as the gutter material is advanced that: a) reside at predetermined intervals along a length of each of the completed gutter pieces, and b) are located to facilitate controlled interval placement of hangers that are used to support the completed gutter pieces in an operative position on a structure.

16 Claims, 10 Drawing Sheets

(56) References Cited

U.S. PATENT DOCUMENTS

| | | | | | |
|---|---|---|---|---|---|
| 3,710,607 | A * | 1/1973 | Beymer | B21D 5/06 | 72/12.5 |
| 3,898,927 | A * | 8/1975 | Murata | B21C 51/005 | 101/110 |
| 4,962,622 | A * | 10/1990 | Albrecht | E04B 5/40 | 52/220.4 |
| 5,079,938 | A * | 1/1992 | Schwarz | B21C 37/126 | 29/407.04 |
| 5,315,090 | A * | 5/1994 | Lowenthal | E04D 13/064 | 219/213 |
| 5,678,359 | A * | 10/1997 | Turner | E04D 13/064 | 52/105 |
| 6,439,020 | B1 * | 8/2002 | Baschnagel, III | B21D 5/08 | 72/181 |
| 6,568,132 | B1 * | 5/2003 | Walters | E04D 13/064 | 52/12 |
| 6,813,919 | B1 * | 11/2004 | Ellis | B21D 5/08 | 72/181 |
| 6,997,026 | B2 * | 2/2006 | Fischer | B21D 5/08 | 52/749.1 |
| 2004/0178303 | A1 * | 9/2004 | Hardin | E04D 13/0725 | 248/48.1 |
| 2009/0014240 | A1 * | 1/2009 | Salisbury | E04D 13/0725 | 182/107 |
| 2017/0058999 | A1 * | 3/2017 | Park | B21B 27/024 | |
| 2017/0204611 | A1 * | 7/2017 | Brochu | E04D 13/076 | |

* cited by examiner

Fig. 4
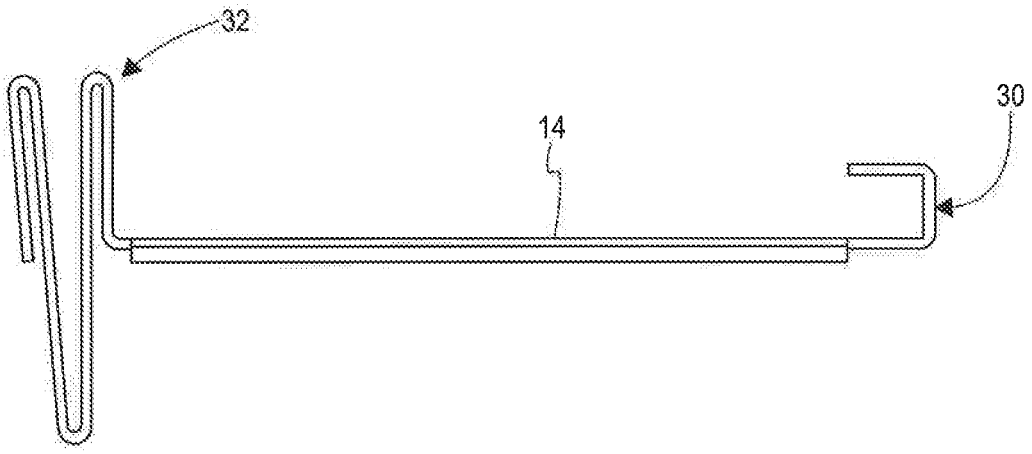
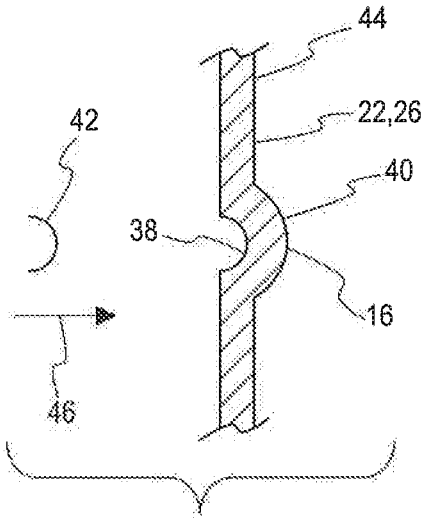
Fig. 5
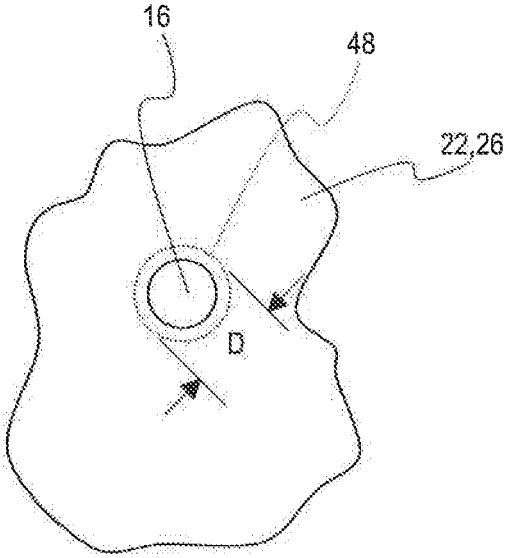
Fig. 6

METHOD FOR STRATEGICALLY MARKING A GUTTER

BACKGROUND OF THE INVENTION

Field of the Invention

This invention relates to gutters and, more particularly, to a method for continuously providing gutter material with marks that facilitate the location of hangers used for installation of completed gutter pieces. The invention is also directed to a gutter piece made by this method.

Background Art

Gutters are commonly installed using supporting hangers that are placed at selected, regular, lengthwise intervals. The optimal interval size is arrived at based upon the particular application. Gutter capacity is a factor influencing hanger spacing. Geographic location may also dictate an appropriate hanger spacing. For example, in climates where heavy snows and ice are anticipated, a narrower hanger spacing may be appropriate to avoid damage to, or dislodging of, gutter pieces. Individual installers may also have a preference for hanger spacing that may deviate from conventional standards. Regardless of the exact intervals selected between hangers, these intervals are commonly divisible by six inches or eight inches. Thus, there is at least a general standardization of hanger intervals.

Hanger placement at controlled, regular intervals is desirable for at least two different reasons. First of all, the controlled spacing, when appropriate, results in a stable gutter installation. Second, the regular spacing of hangers has an aesthetic advantage since the hangers, and/or the associated fasteners, may be visible from the ground or from different elevations, as in a tiered construction.

Heretofore, in the absence of pre-formed hanger openings, installers have identified hanger locations, one by one, using conventional instruments, such as measuring tapes. This process has a number of different drawbacks.

First of all, these measurements may be taken by installers with the gutter pieces preliminarily mounted at potentially a significant height. This may involve rough placement of a limited number of the hangers before additional hangers are installed therebetween. Attempting to handle a measuring instrument while on a ladder or scaffold is inherently awkward, and potentially dangerous. Installers must additionally coordinate the handling of the measuring instrument, the hangers, and the fasteners and tools used to secure the fasteners.

Aside from the inconvenience associated with this conventional installation, it is very difficult to maintain uniform spacing between the hangers. This objective is made particularly difficult by the need to preliminarily hang the gutter by potentially using end hangers and/or one or more mid-length hangers to maintain position. It may be difficult to precisely locate a mid-length hanger such that the desired hanger intervals may be consistently maintained therefrom. Still further, a mismeasurement may result in an improperly located hanger, as a result of which the installer may have to improvise to place hangers at regular intervals not of the contemplated length.

In spite of the above challenges, and others, associated with conventional gutter hanging techniques, the industry has continued to use the same hanger constructions and the same installation steps that have been used for many decades.

SUMMARY OF THE INVENTION

In one form, the invention is directed to a method of forming gutter pieces. The method includes the steps of: obtaining a gutter forming apparatus; obtaining a supply of gutter material; through the gutter forming apparatus, progressively forming the gutter material into completed gutter pieces, each with a length, as the gutter material is advanced in a forming path, wherein the gutter forming apparatus is made up of a subassembly configured to make discrete visible marks on the gutter material; and through the subassembly continuously making discrete visible marks on the gutter material as the gutter material is advanced that: a) reside at predetermined intervals along a length of each of the completed gutter pieces; and b) are located to facilitate controlled interval placement of hangers that are used to support the completed gutter pieces in an operative position on a structure.

In one form, the gutter forming apparatus is configured so that the subassembly is making discrete marks on the gutter material as the gutter material is being formed into the completed gutter pieces.

In one form, the discrete marks are each made by shaping the gutter material.

In one form, the discrete marks are each in the form of an impressed dimple.

In one form, the discrete marks are each in the form of a gap between parts of at least one discrete shape formed in the gutter material.

In one form, the at least one discrete shape is in the form of at least one elongate rib.

In one form, the discrete marks are permanently formed on the completed gutter pieces.

In one form, the discrete marks can each be circumscribed by a circle with a diameter no greater than ⅜".

In one form, the discrete marks can each be circumscribed by a circle with a diameter no greater than ¼".

In one form, each completed gutter piece has a bottom wall, a back wall, a front wall, and a lip projecting from a top region of the front wall towards the back wall. The discrete marks are made on the back wall.

In one form, each completed gutter piece has a bottom wall, a back wall, a front wall, and a lip projecting from a top region of the front wall towards the back wall. The discrete marks are made on the lip.

In one form, the subassembly has a forming wheel that turns around a first axis and has at least one radial projection that is pressed against the advancing gutter material as the forming wheel is turned to cause the discrete marks to be made by forming impressions on the advancing gutter material as the forming wheel turns around the first axis.

In one form, the subassembly has a dome-shaped projection that forms the impressed dimple.

In one form, the predetermined intervals are approximately 8".

In one form, the subassembly further includes a backing wheel with a receptacle for the at least one radial projection. The backing wheel is mounted for turning around a second axis that is substantially parallel to the first axis.

In one form, the forming and backing wheels are configured to cooperate to form a continuous rib in the gutter piece as the gutter material is advanced in the forming path.

In one form, each of the marks is an impression in the gutter material. Each of the impressions is cup shaped, with oppositely facing concave and convex surfaces.

In one form, the completed gutter piece has a bottom wall, a back wall, and a front wall. The back wall has forwardly and rearwardly facing surfaces. The convex surface is at the forwardly facing surface of the back wall.

In one form, the invention is directed to a gutter piece made up of a body having a length. The body has a bottom wall, a back wall, a front wall, and a lip projecting from a top region of the front wall towards the back wall. The body has discrete visible marks made thereon that: a) reside at predetermined intervals along a length of the completed gutter piece; and b) are located to facilitate controlled interval placement of hangers that are used to support the gutter piece in an operative position on a structure.

In one form, the discrete visible marks are permanently formed by shaping the body.

In one form, the impressions are provided on at least one of the lip and the back wall.

In one form, the impressions each has a cup shape.

In one form, the impressions each can be circumscribed by a circle with a diameter not greater than ⅜".

In one form, the discrete visible marks are spaced from each other a distance equal to approximately 8".

BRIEF DESCRIPTION OF THE DRAWINGS

FIG. 4 is an enlarged, side elevation view of the hanger in FIG. 3;

FIG. 5 is an enlarged, fragmentary, cross-sectional view of one of the marks on at least one of a lip and back wall on the gutter piece in FIG. 2;

FIG. 6 is an enlarged, fragmentary view of a part of the gutter piece with the mark in FIG. 5 thereon;

DETAILED DESCRIPTION OF THE PREFERRED EMBODIMENT

Figure 1:
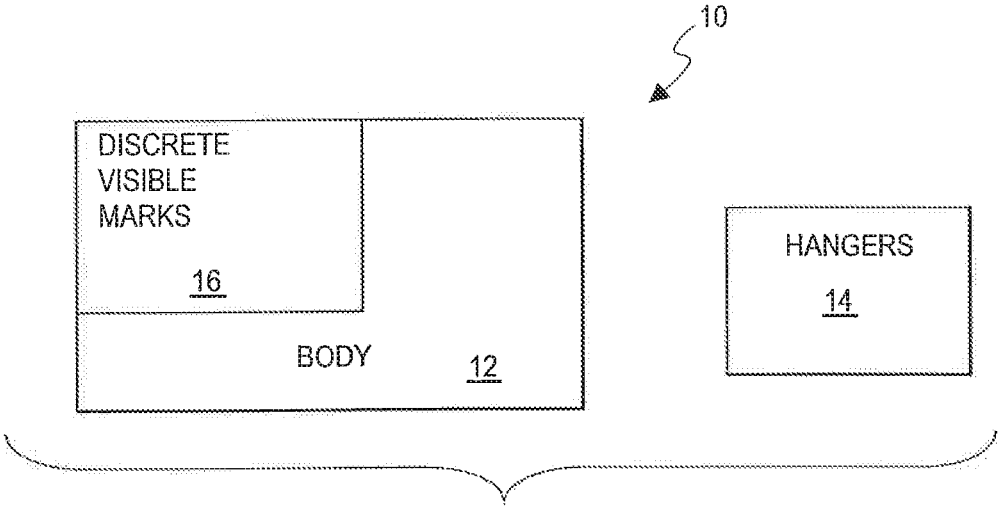
FIG. 1 is a schematic representation of a gutter piece consisting of a body with discrete visible marks thereon, according to the invention, and in relationship to hangers used to support the gutter piece in an operative position on a structure.

In FIG. 1, a gutter piece, according to the present invention, is shown at 10. The gutter piece 10 consists of a body 12 that is secured to a structure, typically a roof, by a plurality of hangers 14 spaced at strategically controlled intervals along the length of the body 12. Exemplary forms of gutter pieces and hangers therefor are shown in U.S. Pat. No. 8,347,557, the disclosure of which is incorporated herein by reference. The gutter piece, when attached, collects and guides water flowing off of a surface of the roof.

The schematic showing of the gutter body 12 and hangers 14 in FIG. 1 is intended to encompass virtually an unlimited number of variations of these basic components. The specific form of gutter body 12, shown and described herein, is exemplary in nature only.

According to the invention, discrete, visible marks 16 are made on the body 12 at predetermined intervals along the length of the body 12 to facilitate controlled interval placement of the hangers 14.

The marks 16 may take virtually an unlimited number of different forms—permanent or non-permanent in nature. In exemplary forms, as described hereinbelow, the marks 16 are produced by shaping the body 12, with strategically located dimples, gaps, projections, etc. defining the marks 16.

Figure 3:
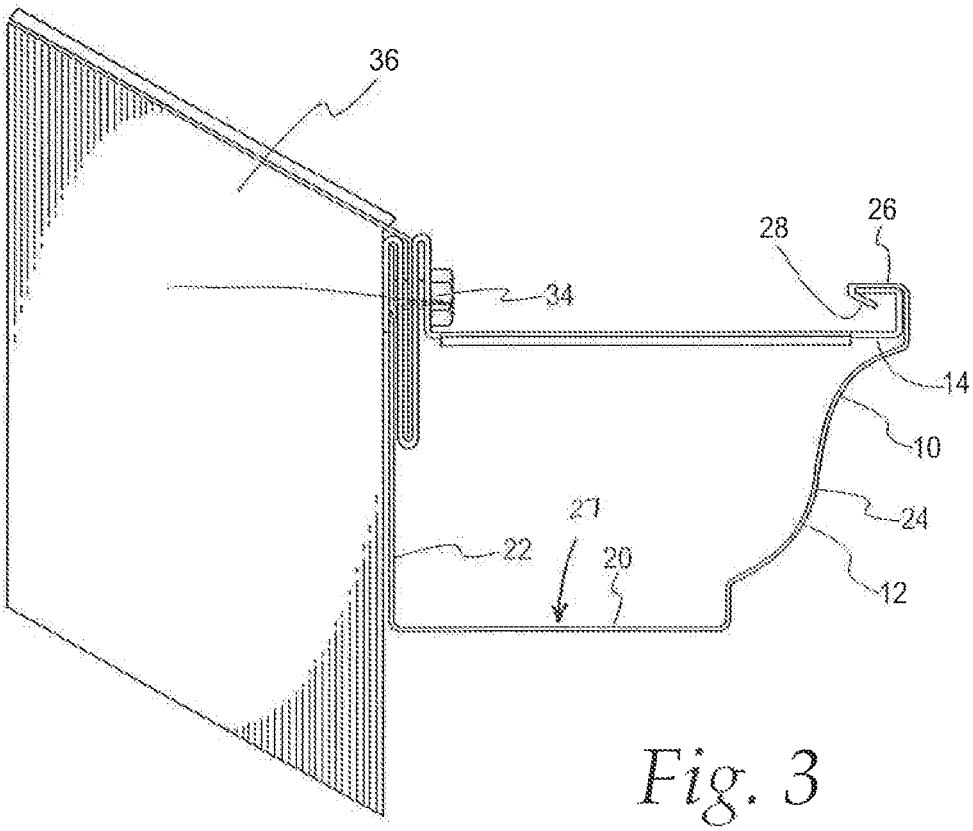
FIG. 3 is a side elevation view of the gutter piece in FIG. 2 in an operative position upon a structure using one specific form of hanger, as shown schematically in FIG. 1.
Figure 2:
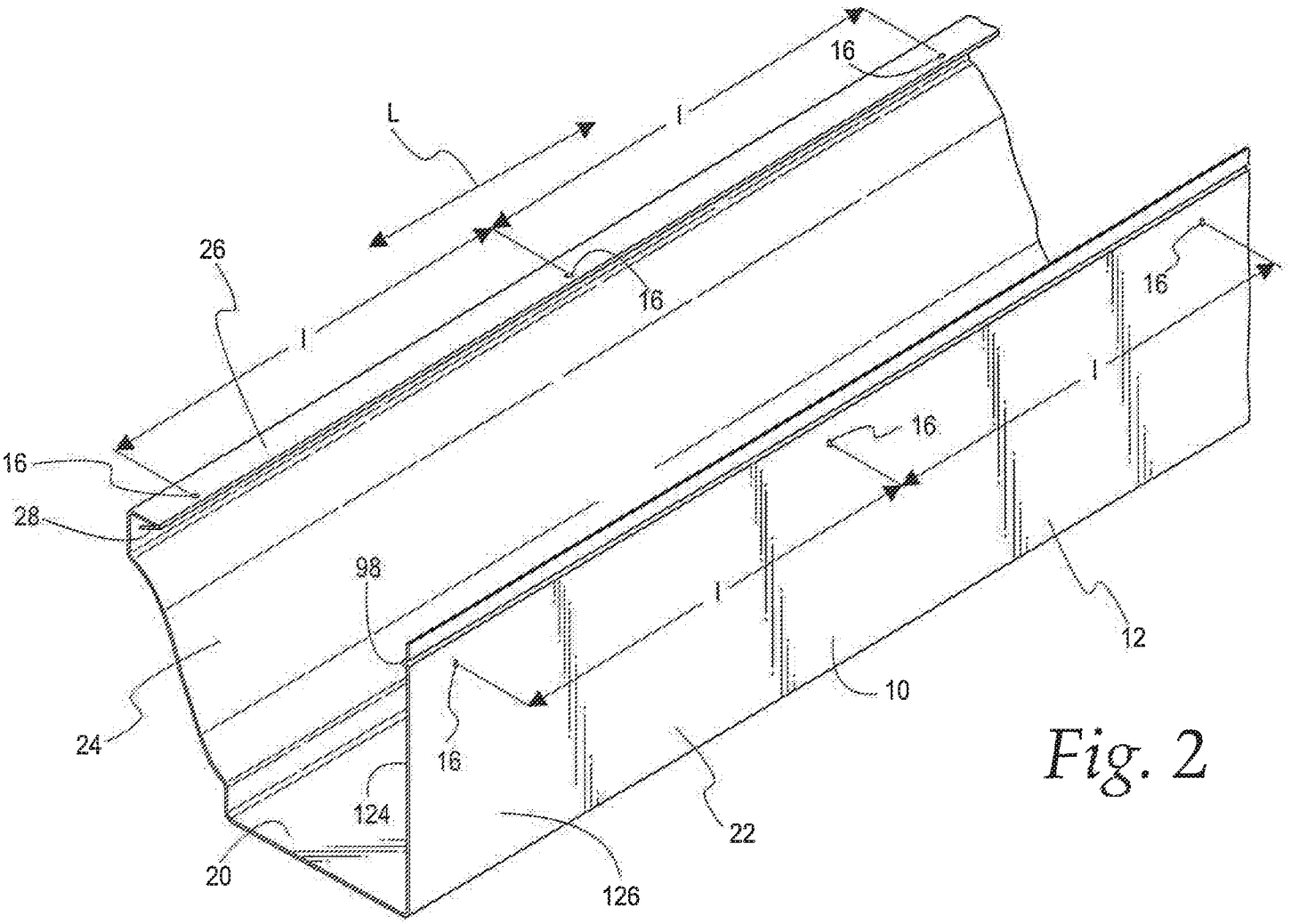
FIG. 2 is a fragmentary, perspective view of one specific form of gutter piece, as shown schematically in FIG. 1, with one form of mark thereon.
Figure 7:
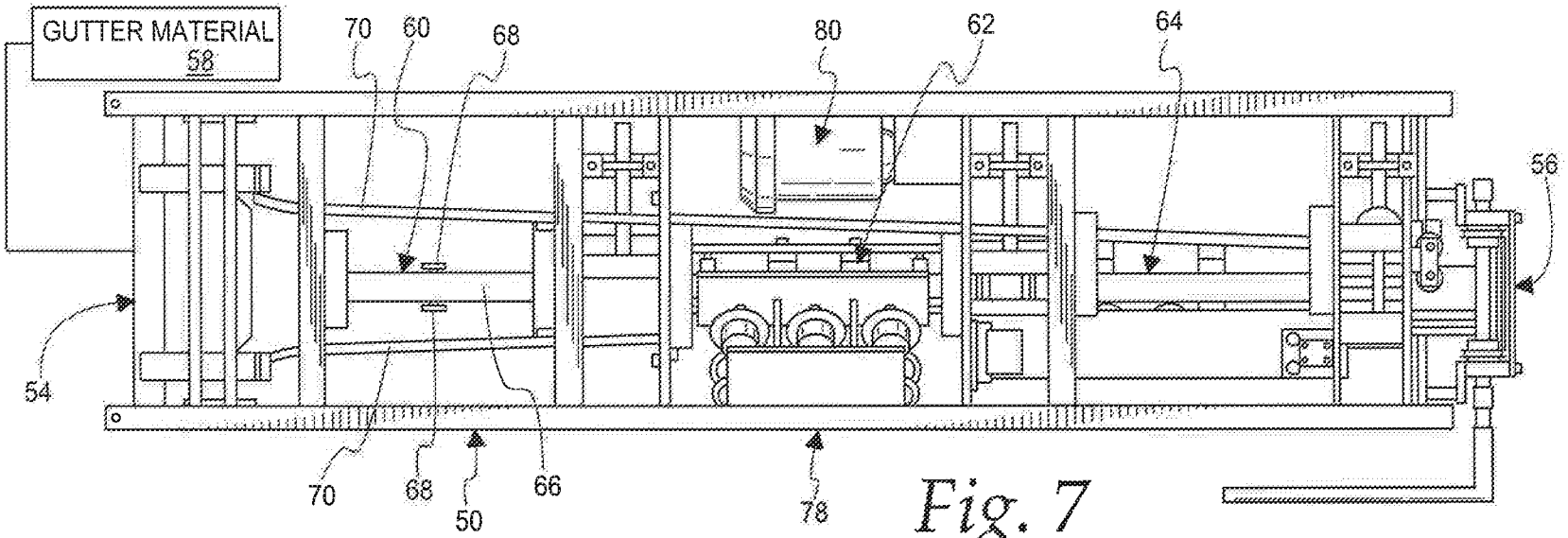
FIG. 7 is a plan view of an exemplary gutter forming apparatus used to form the gutter pieces in FIGS. 2 and 3, with the markings thereon.
Figure 8:
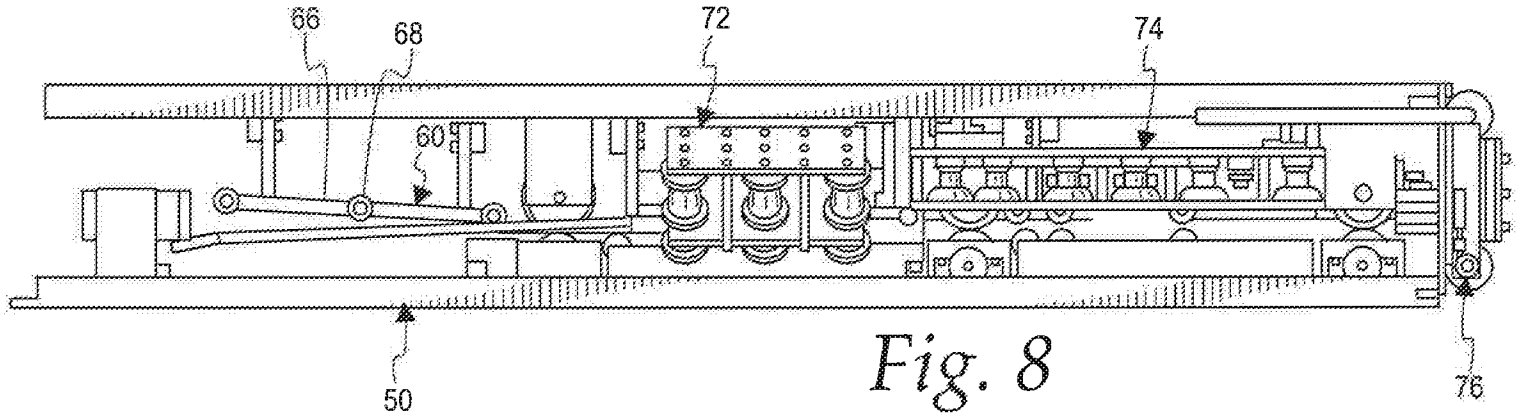
FIG. 8 is a side elevation view of the apparatus in FIG. 7.
Figure 9:
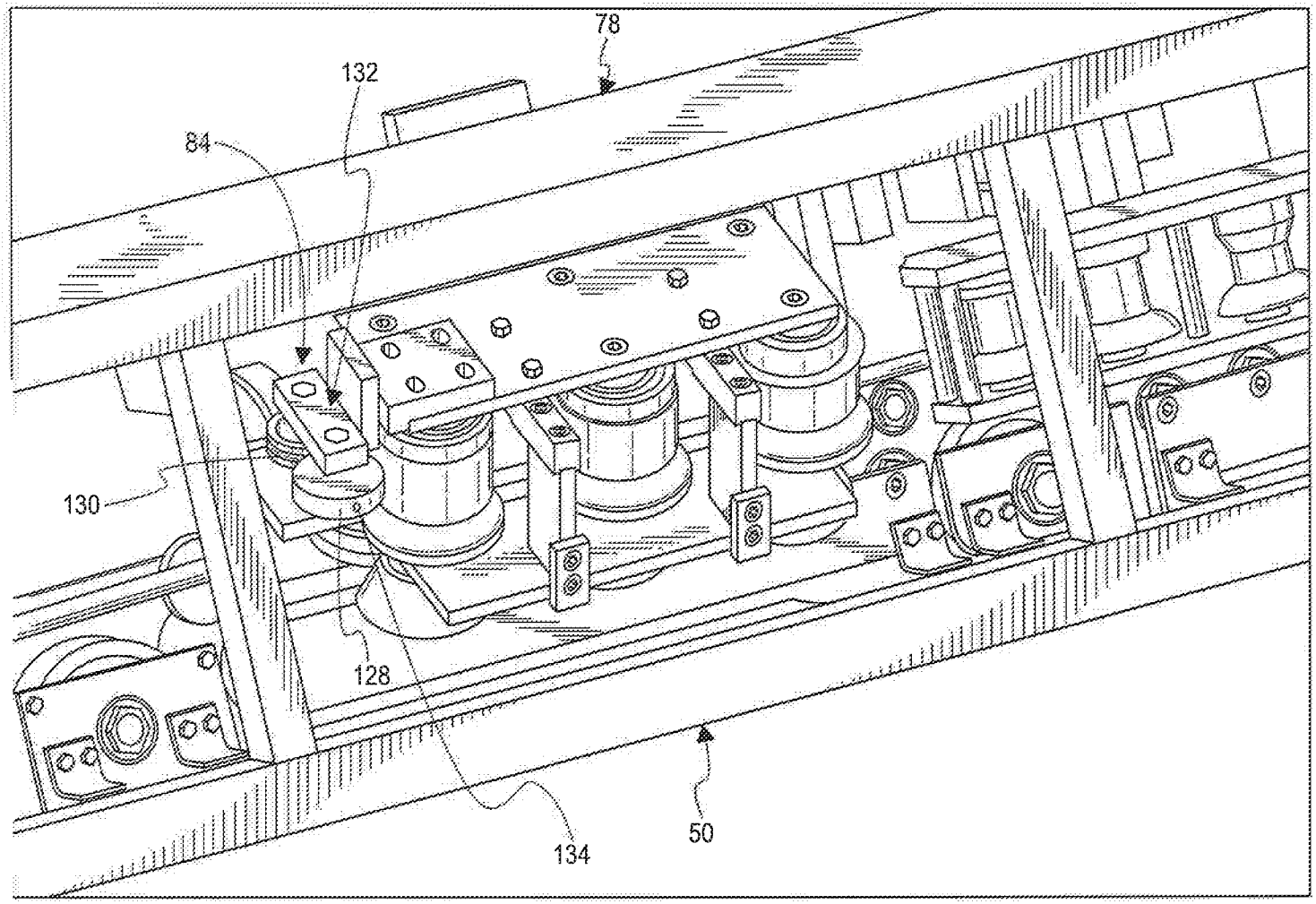
FIG. 9 is an enlarged, fragmentary, perspective view of a part of the apparatus in FIGS. 7 and 8 and showing a subassembly for forming marks on the lips of gutter pieces.
Figure 10:
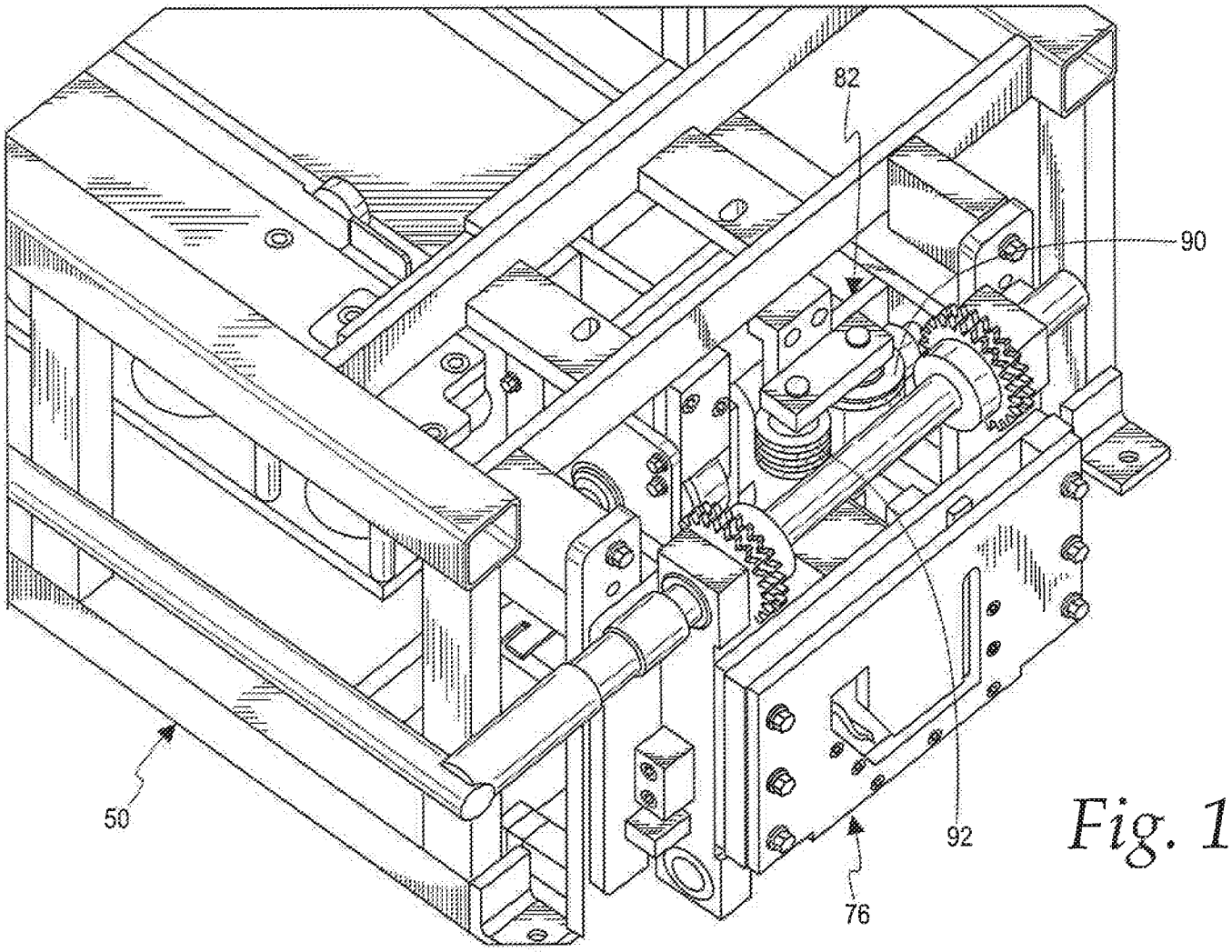
FIG. 10 is an enlarged, fragmentary, perspective view of another part of the apparatus in FIGS. 7 and 8 and showing a separate subassembly for forming marks on the back walls of gutter pieces and simultaneously forming reinforcing ribs thereon.
Figure 11:
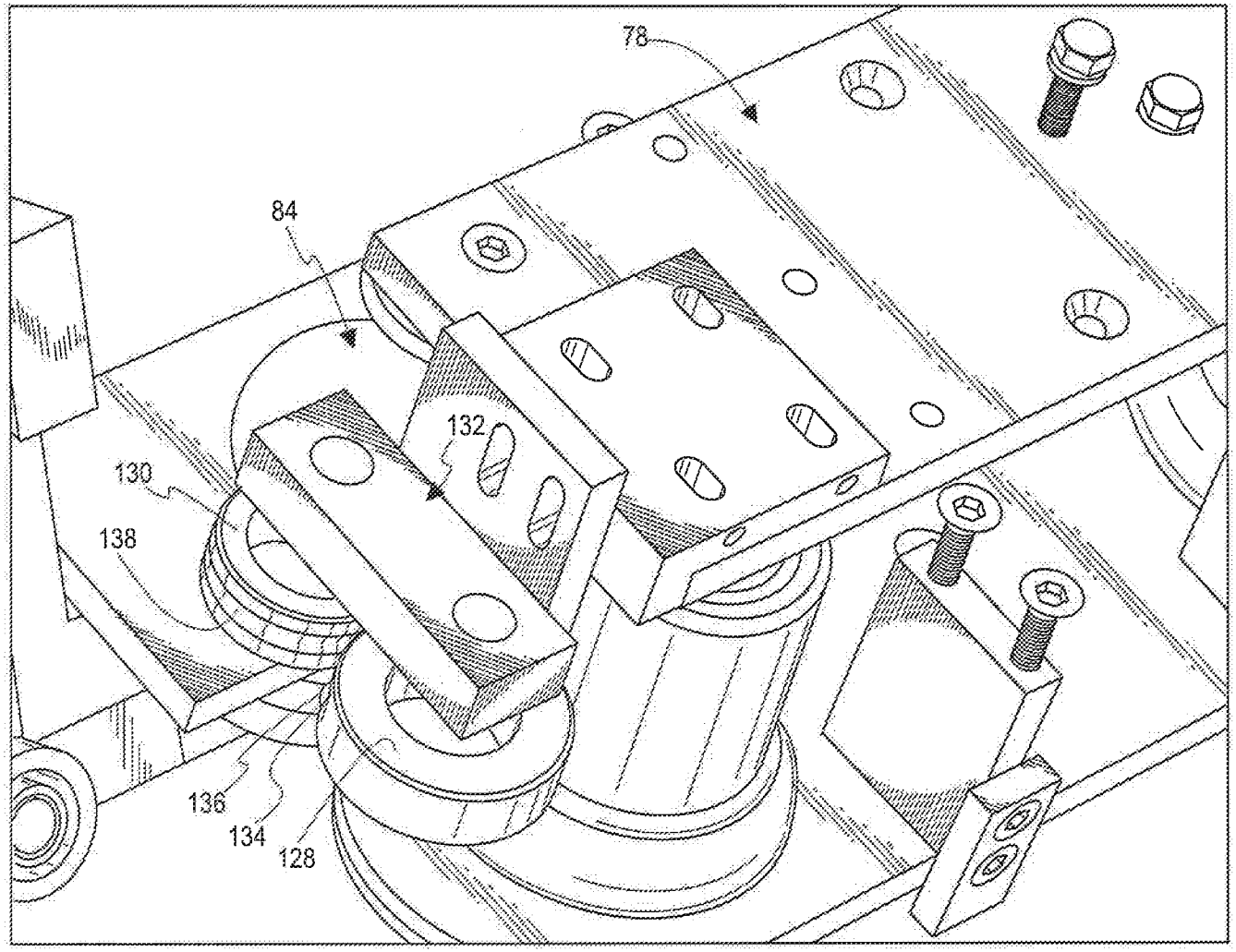
FIG. 11 is an enlarged, perspective view of the subassembly in FIG. 9.

An exemplary gutter piece 10 is shown with an exemplary form of the hanger 14 in FIGS. 2-4. The body 12 of the gutter piece 10 has a bottom wall 20, a back wall 22, a front wall 24, and a lip 26 projecting from a top region of the front wall 24 towards the back wall 22. The bottom wall 20, back wall 22, and front wall 24 define a water collection volume 27. The lip 26 has a return bend 28 projecting angularly forwardly.

The hangers 14 have front and rear connecting configurations 30, 32, respectively. The front connecting configuration 30 engages at the front wall 24 of the gutter piece body 12 in supporting relationship to the lip 26. The rear connecting configuration 32 engages the back wall 22 on the gutter piece body 12. The relationship between each of the connecting configurations 30, 32 and the gutter piece 10 is described in greater detail in U.S. Pat. No. 8,347,557.

With a hanger 14 operatively situated in relationship to the gutter piece body 12, a fastener 34 is directed through the hanger 14 and the back wall 22 and into a support structure 36 to thereby maintain the gutter piece 10 in an operative position upon the support structure 36, as shown in FIG. 3, shown as a roof with an inclined surface which directs water on the roof to within the collection volume 27 defined by the gutter piece 10.

As described above, hanger placement varies depending upon the particular dimensions and capacity of the gutter piece 10 and the particular environment in which it will be used. For example, in harsh climates where ice and snow commonly bear upon gutter pieces 10 over extended periods during a winter season, spacing between the hangers 14 may be reduced compared to spacing practical for warmer and tropical climates. Generally, a rule of thumb is that gutter hangers should not be spaced by more than 36" on center. In colder climates, this maximum generally is recognized as approximately 18". Generally, recommended hanger spacing is on the order of 24".

As noted above, hanger locations generally are identified by using conventional measuring tools to make temporary marks or identify individual hanger locations as they are serially attached and anchored to the support structure 36.

By strategically placing discrete visible marks 16 at regular intervals I, corresponding to common hanger spacing, along the length of the body 12, as indicated by the double-headed arrow L, an installer can use the marks 16 to locate the hangers 14, potentially without further marking of the gutter piece 10 or using any type of separate measuring tool. In one preferred form, the intervals I are approximately 8". In an alternative form, the intervals I may be approximately 6". Other spacing intervals I are contemplated.

While the marks 16, within the generic showing at FIG. 1, could take a variety of different forms, it is preferable, though not critical, that the marks 16 be permanent, whereby they cannot be readily rubbed off so that they will be consistently present, even after the gutter pieces 10 are repeatedly handled, packed, shipped, etc. At the same time, it is preferred that the marks 16 not interfere with the normal function of the hanger notably the interaction between the hanger 14 and the supporting structure 36. Still further, it is desirable that while the marks 16 be visible from an installer's up-close perspective, they not be obtrusive or detract from the overall appearance of the gutter piece 10.

In one exemplary form, as shown additionally in FIGS. 5 and 6, a mark 16 is impressed upon one or both of the back wall 22 and lip 26. While not so limited, each of the impressions is shown to be in the form of a cup-shaped dimple with oppositely facing concave and convex surfaces 38, 40, respectively.

As shown clearly in FIGS. 5 and 6, the impressed dimple may be formed by advancing a dome-shaped surface 42 forcibly against the layer 44 in the direction of the arrow 46 in FIG. 5 to effect material shaping/deformation.

The rounded dimple is just one exemplary, preferred, permanent form for the particular mark/impression 16. Other permanent forms of marking and shape are contemplated. To avoid an unsightly appearance, it is preferred that the particular mark 16 be capable of being circumscribed by a circle, as shown in dotted lines at 48 in FIG. 6, that has a diameter D no greater than ¼". In a more preferred form, the diameter D is no greater than ⅜". While preferred, this mark size is not critical.

In one preferred form, the marks 16 are made using a gutter forming apparatus as shown at 50 in FIGS. 7-14. It is not necessary to understand the details of operation of the gutter forming apparatus 50 and the basic operation will be described hereinbelow to the extent necessary to explain the cooperation between the basic apparatus 50 and one or more subassemblies thereon that produce the marks 16 on the gutter pieces 10.

Briefly, the gutter forming apparatus 50 has an input end 54 and an output end 56. Gutter material 58, as in the form of a coiled sheet, is fed to the input end 54 and moves in a forming path through the apparatus 50 and is discharged as a completed gutter piece 10 at the output end 56.

The gutter material 58 passes serially under skate assemblies 60, 62, 64, with exemplary skate assembly 60 made up of a block 66 with spaced side bearings 68.

Introduced gutter material 58 is progressively folded by converging guide bars 70 at the sides of the skate assemblies 60, 62, 64.

A facebox assembly 72 forms the curved contour of the front wall 24.

Downstream of the facebox assembly 72 is a lipbox assembly 74 that forms the lip 26.

The fully formed gutter material 58 then passes through a guillotine assembly 76 that effects severance of the advancing material 58 to produce individual, completed gutter pieces 10 of the desired length.

All apparatus operating components are mounted upon a frame 78 and driven by a motor and gearbox at 80.

The gutter material 58 can be continuously fed to the gutter forming apparatus 50 to continuously produce fully formed gutter pieces 10.

As noted above, the impressions/marks 16 can be made on one or both of the back wall 22 and lip 26. Separate subassemblies 82, 84 are provided on the frame 78 to respectively make the marks 16 on the back wall 22 and lip 26.

The subassembly 82 consists of a subframe 86 that is attached to the main frame 78. A cantilevered platform 88 on the subframe 86 supports a forming wheel 90 and backing wheel 92 that turn around substantially parallel axes 94, 96, respectively. The wheels 90, 92 cooperate to continuously form the marks 16 as the gutter material 58 is advanced through the gutter forming apparatus 50 and additionally cooperate to form a continuous rib 98 (FIG. 2) on the gutter pieces 10 above the marks 16.

In this embodiment, a marking pin 100 is fixed in the peripheral wall 102 of the forming wheel 90 and projects radially to beyond a peripheral surface 104 to define the aforementioned dome-shaped surface 42.

The diameter of the forming wheel 90 is selected so that upon each revolution, the surface 42 produces a mark on the advancing gutter material 58 at the preselected distance/interval I from the last formed mark 16.

It is conceivable that more than one marking pin 100 might be placed upon the forming wheel 90 so that more than one mark 16 is made for each revolution.

The wheel 92 has an annular receptacle 106 formed through the peripheral outer surface 108 thereon to accommodate the projecting portion of the marking pin 100.

The forming wheel 90 has a projecting annular bead 110 spaced axially from the location of the projecting surface 42 to cooperate with a separate receptacle 112 on the backing wheel 92, to allow the reinforcing rib 98 to be continuously formed by shaping the back wall material as the marks 16 are being continuously formed at spaced lengthwise intervals therebelow.

Figure 14:
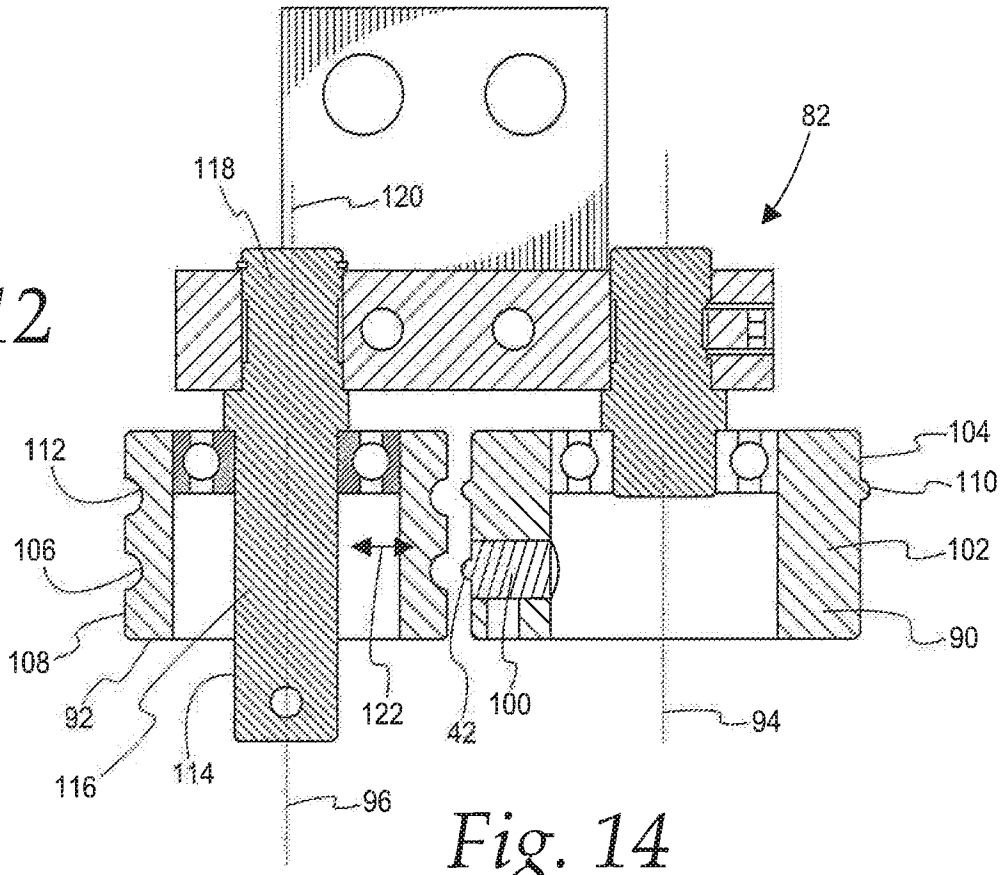
FIG. 14 is an enlarged, cross-sectional view of the subassembly taken along line 14-14 of FIG. 12.
Figure 12:
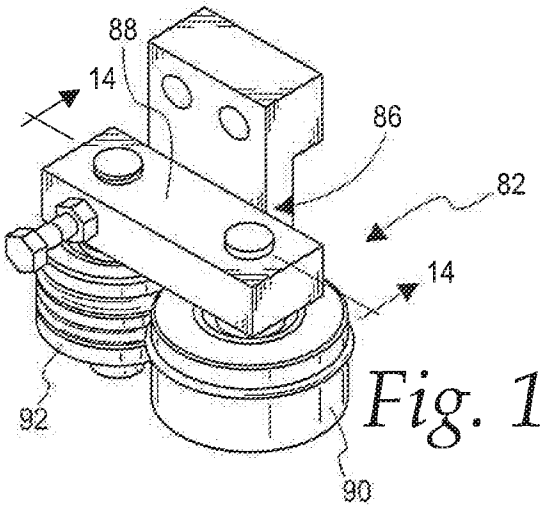
FIG. 12 is an enlarged, perspective view of the subassembly shown in FIG. 10.
Figure 13:
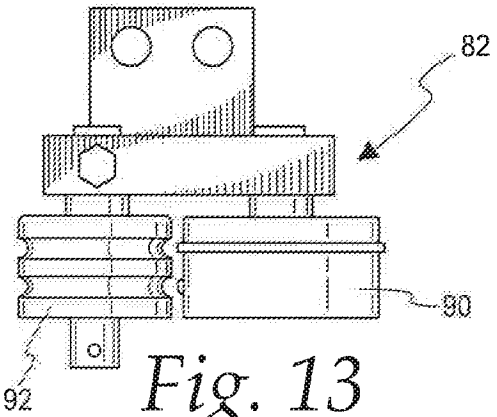
FIG. 13 is an enlarged, end elevation view of the subassembly shown in FIG. 12.

As seen most clearly in FIG. 14, a shaft 114, that supports the forming wheel 92 for turning under the platform 88, has a primary length 116, around which the forming wheel 92 is journaled for rotation, and a separate mounting length 118 with an axis 120 that is offset from the axis 96. By turning the mounting length 118 around the axis 120 relative to the platform 88, the forming wheel 92 can be moved, as indicated by the double-headed arrow 122, towards and away from the wheel 90, orthogonally to axes 94, 96, to adjust the relationship between the bead 110 and surface 42 and their cooperating receptacles 112, 106, respectively.

With this arrangement, the mark 16 is formed so that the back wall 22 is deformed/shaped by being locally pressed forwardly by the surface 42 to make the impression, whereby the convex surface 40 (FIG. 5) is at a forwardly facing surface 124 on the back wall 22, with the concave surface 38 on a rearwardly facing surface 126. This, however, is not a requirement.

The subassembly 84 is located upstream of the lipbox assembly 74 and at the entry to the facebox assembly 72 to allow the marks 16 to be made upon the advancing gutter material 58 at the lip location on the gutter material 58 before the lip 26 is bent into its final, horizontal orientation.

The advancing gutter material 58 moves between the forming wheel 128 and backing wheel 130 that are mounted to the frame 78 through a subframe assembly 132. The wheels 128, 130 cooperate in the same fashion as the wheels 90, 92, respectively, with the exception that there is no corresponding bead 110 and cooperating receptacle 112. The forming wheel 128 has a marking pin 134 with a dome-shaped surface 136 that cooperates with an annular receptacle 138 on the wheel 130 to produce the marks 16 at desired intervals.

As described hereinabove, the marks 16 are formed simultaneously as the gutter material 58 is moved in its predetermined forming path and shaped through the various stages to form the completed gutter pieces 10. The invention also contemplates that the marks 16 may be formed before or after the formation of the gutter material 58 into its final shape. For purposes of simplicity, the various components—such as the subassemblies 82, 84—will be considered part of the same gutter forming apparatus 50 even in the event that they are not operated to produce marks 16 as the gutter material 58 is being formed into its final shape. For example, the marks 16 could be continuously formed as the completed gutter pieces are advanced.

Figure 15:
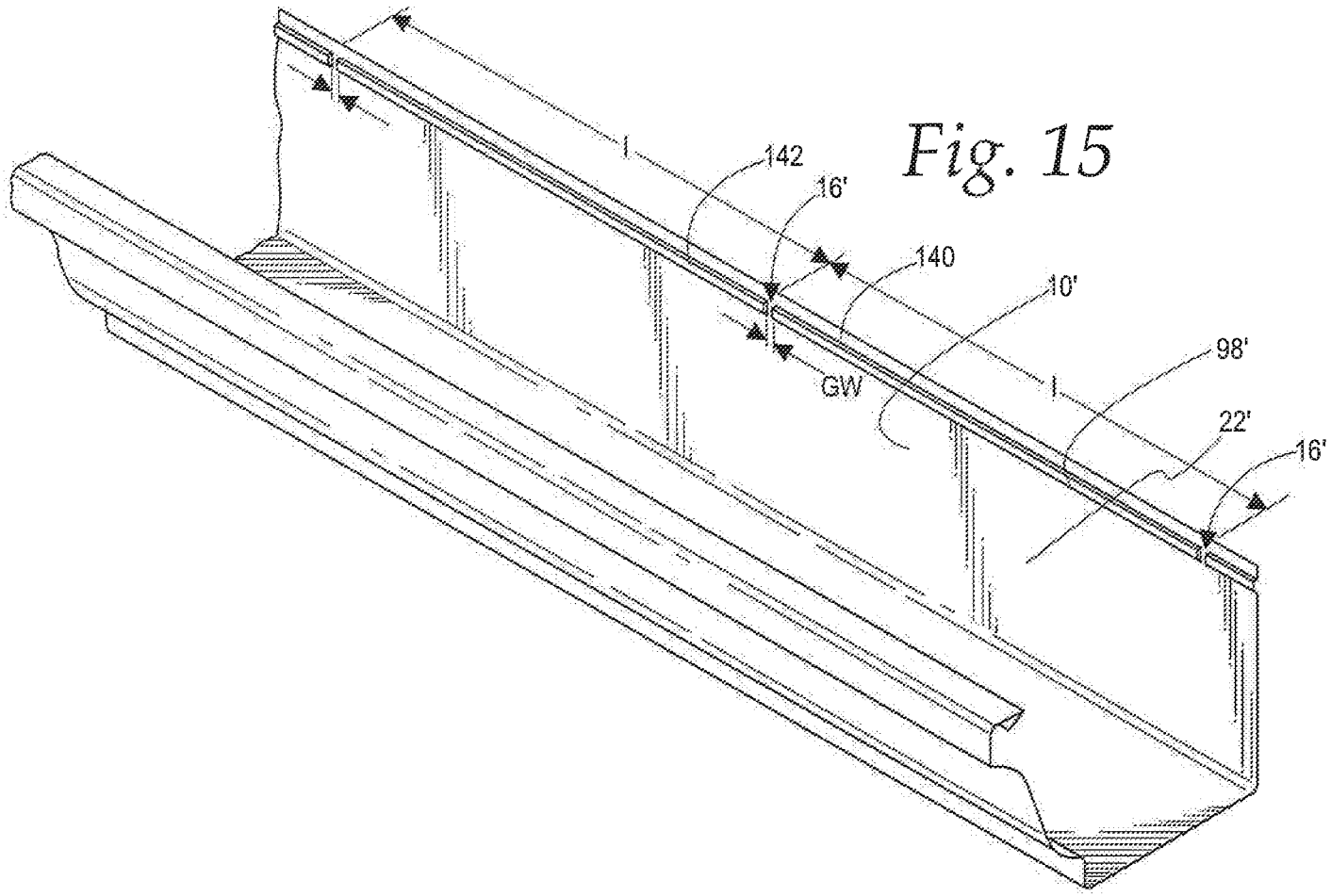
FIG. 15 is a view as in FIG. 2 of a modified form of gutter piece with a different form of the inventive mark.

In FIG. 15, a modified form of gutter piece is shown at 10'. The gutter piece 10' has the same overall configuration, and may be formed in substantially the same manner, as the gutter piece 10. The gutter piece 10' differs in that corresponding marks 16' have a different configuration than the marks 16 on the gutter 10.

Rather than shaping the gutter material at each mark location, the marks 16' are made by shaping the rib 98' corresponding to the rib 98, so that the marks 16' are actually gaps between adjacent parts 140, 142 of the rib 98'.

The gap may result from any change in the continuous running shape of the rib 98'. As depicted, the marks 16' reside where there is no shaping of the material of the back wall 22'. It is possible that the region of the mark 16' could be shaped to project to a lesser degree than the parts 140, 142 that bound the mark 16'.

As depicted, the mark 16' has a width GW on the order of 0.125 inches. This should not be viewed as limiting, as any width that is visible to an installer is contemplated.

Figure 16:
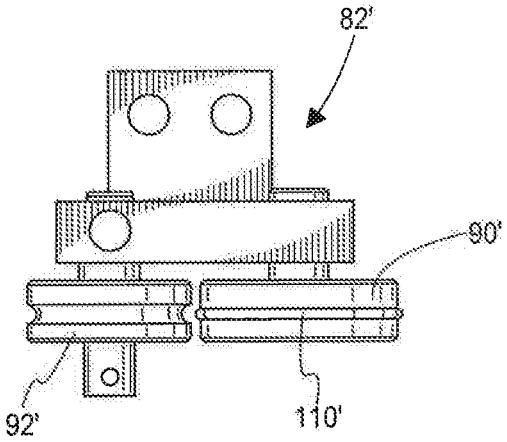
FIG. 16 is a view as in FIG. 13 of a modified form of subassembly used to make the marks in FIG. 15.
Figure 17:
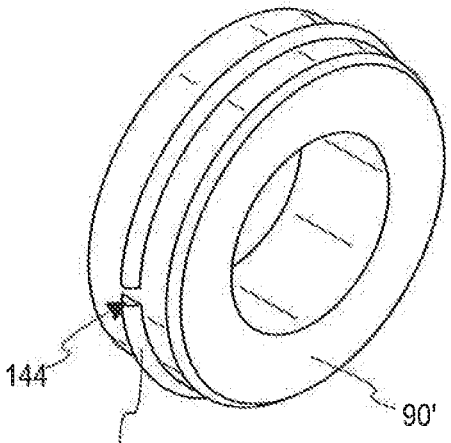
FIG. 17 is an enlarged, perspective view of a forming wheel on the subassembly in FIG. 16.

By forming the mark 16' as a change in the shape of the rib 98', the rib 98' and mark 16' can be formed simultaneously using a subassembly 82', as shown in FIGS. 16 and 17. The subassembly 82' has forming and backing wheels 90', 92', functioning as the aforementioned forming and backing wheels 90, 92. The primary distinction is that the marking pin 100 is eliminated and the subassembly 82' is dedicated to forming only the rib 98' with the marks 16' along the length thereof.

To accomplish this, an annular bead 110' on the forming wheel 90' has an interruption at 144 that produces a mark 16' with each revolution at the desired interval I.

Figure 18:
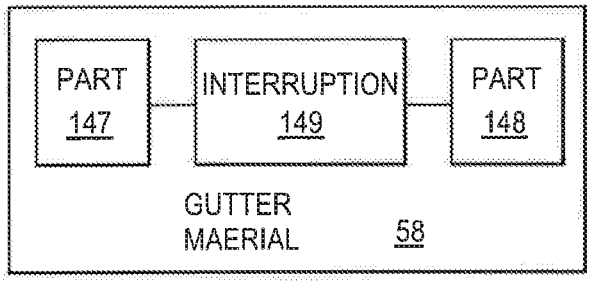
FIG. 18 is a schematic representation of gutter material with a mark as shown in FIG. 15.

As shown in FIG. 18, the concept described with respect to FIGS. 15-17 has a more generic application. As seen therein, gutter material 58 is shaped to define discrete parts 147, 148 between which there is a visible interruption 149 that functions as the mark 16'. The parts 147, 148 may extend continuously along the length of the gutter pieces or may extend to a lesser extent. "Continuous" is intended to encompass the lengthwise extension even though there is a partial or full gap whereat the mark 16' is formed.

Figure 19:
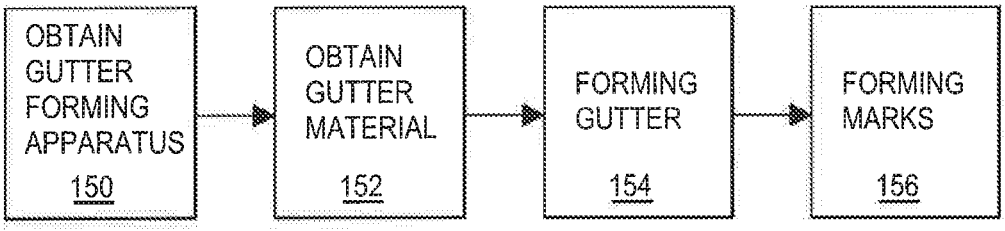
FIG. 19 is a flow diagram representation of a method of forming a gutter with markings thereon, according to the invention.

With the structures described above, a method of forming a gutter piece can be carried out, as shown in flow diagram form in FIG. 19.

As shown at block 150, access is obtained to a gutter forming apparatus.

As shown at block 152, a supply of gutter material is obtained.

As shown at block 154, through the gutter forming apparatus, the gutter material is progressively formed into a completed gutter piece with a length as the gutter material is advanced in a forming path. The gutter forming apparatus has at least one subassembly configured to make discrete, visible marks on the gutter material.

As shown at block 156, through the subassembly, discrete, visible marks are continuously made on the gutter material as the gutter material is advanced and: a) reside at predetermined intervals along a length of the completed gutter piece; and b) are located to facilitate controlled interval placement of hangers that are used to support the completed gutter piece in an operative position on a structure.

As noted above, the various subassemblies may make the discrete marks as the gutter material is being formed into a completed gutter piece or separately from the process that shapes the gutter material into its basic desired end shape.

The foregoing disclosure of specific embodiments is intended to be illustrative of the broad concepts comprehended by the invention.

The invention claimed is:

1. A method of forming gutter pieces to be attached to a roof structure to collect water flowing off of a surface of the roof structure, the method comprising the steps of:

obtaining a gutter forming apparatus;

obtaining a supply of gutter material;

through the gutter forming apparatus, progressively forming the gutter material into completed gutter pieces, each with a length, as the gutter material is advanced in a forming path, wherein the gutter forming apparatus comprises a subassembly configured to make discrete visible marks on the gutter material; and continuously making the discrete visible marks on the gutter material using the subassembly as the gutter material is advanced so that the discrete visible marks: a) reside at predetermined intervals along a length of each of the completed gutter pieces; b) are located so that a user can visibly identify the predetermined intervals to facilitate controlled lengthwise interval placement of hangers that are used to support the completed gutter pieces in an operative position on a structure; and c) are produced by pressing against the gutter material to effect material shaping/deformation and thereby producing impressions in the gutter material without creating openings fully through the gutter material.

2. The method of forming gutter pieces according to claim 1 wherein the gutter forming apparatus is configured so that the subassembly is making the discrete marks on the gutter material as the gutter material is being formed into the completed gutter pieces.

3. The method of forming gutter pieces according to claim 1 wherein the discrete marks are each in the form of an impressed dimple.

4. The method of forming gutter pieces according to claim 3 wherein the subassembly comprises a dome-shaped projection that forms the impressed dimple.

5. The method of forming gutter pieces according to claim 1 wherein the discrete marks are each in the form of a gap between parts of at least one discrete shape formed in the gutter material.

6. The method of forming gutter pieces according to claim 5 wherein the at least one discrete shape is in the form of at least one elongate rib with a length aligned with the length of a respective gutter piece.

7. The method of forming gutter pieces according to claim 1 wherein the discrete marks can each be circumscribed by a circle with a diameter no greater than ⅜".

8. The method of forming gutter pieces according to claim 1 wherein the discrete marks can each be circumscribed by a circle with a diameter no greater than ¼".

9. The method of forming gutter pieces according to claim 1 wherein each completed gutter piece has a bottom wall, a back wall, a front wall, and a lip projecting from a top region of the front wall towards the back wall and the discrete marks are made on the back wall.

10. The method of forming gutter pieces according to claim 1 wherein each completed gutter piece has a bottom wall, a back wall, a front wall, and a lip projecting from a top region of the front wall towards the back wall and the discrete marks are made on the lip.

11. The method of forming gutter pieces according to claim 1 wherein the predetermined intervals are approximately one of: a) 6" or b) 8".

12. The method of forming gutter pieces according to claim 1 wherein the subassembly comprises a forming wheel that turns around a first axis and has at least one radial projection that is pressed against the advancing gutter material as the forming wheel is turned to cause the discrete marks to be made by forming impressions on the advancing gutter material as the forming wheel turns around the first axis.

13. The method of forming gutter pieces according to claim 12 wherein the subassembly further comprises a backing wheel with a receptacle for the at least one radial projection, the backing wheel mounted for turning around a second axis that is substantially parallel to the first axis.

14. The method of forming gutter pieces according to claim 13 wherein the forming and backing wheels are configured to cooperate to form a continuous rib in the gutter piece as the gutter material is advanced in the forming path.

15. The method of forming gutter pieces according to claim 1 wherein each of the marks comprises an impression in the gutter material and each of the impressions is cup shaped, with oppositely facing concave and convex surfaces.

16. The method of forming gutter pieces according to claim 15 wherein the completed gutter piece has a bottom wall, a back wall, and a front wall, the back wall has forwardly and rearwardly facing surfaces, and the convex surface is at the forwardly facing surface of the back wall.

* * * * *